US006973730B2

(12) United States Patent
Tomassetti et al.

(10) Patent No.: US 6,973,730 B2
(45) Date of Patent: Dec. 13, 2005

(54) FLEXIBLE RAZOR AND DISPENSER WITH PIVOTING HEAD

(76) Inventors: Louis D. Tomassetti, 2745 E. Atlantic Blvd., Suite 300, Pompano Beach, FL (US) 33062; Christian T. Scheindel, 172 Peavine Blvd., Bethel, VT (US) 05032

( * ) Notice: Subject to any disclaimer, the term of this patent is extended or adjusted under 35 U.S.C. 154(b) by 0 days.

(21) Appl. No.: 10/982,468

(22) Filed: Nov. 5, 2004

(65) Prior Publication Data

US 2005/0060898 A1 Mar. 24, 2005

Related U.S. Application Data

(62) Division of application No. 10/389,855, filed on Mar. 14, 2003, now abandoned.

(51) Int. Cl.[7] ..... B26B 21/52
(52) U.S. Cl. ..... 30/527
(58) Field of Search ..... 30/527, 531, 41, 30/41.5, 529, 530, 535, 534

(56) References Cited

U.S. PATENT DOCUMENTS 5,070,611 A * 12/1991 Derin et al. ..... 30/41
6,311,400 B1 * 11/2001 Hawes et al. ..... 30/527

* cited by examiner

*Primary Examiner*—Douglas D Watts
(74) *Attorney, Agent, or Firm*—Robert M. Downey, PA

(57) ABSTRACT

A razor includes a handle, a flexible neck extending from the top of the handle and a blade-carrying razor head pivotally fitted on the distal end portion of the neck. A lower portion of the handle functions as an actuator for dispensing shaving material contained within the handle and is operable between a stop position and a dispensing position. The neck is structured to flex and/or twist in a yielding action in response to external forces as the blade-carrying razor head travels over irregular or varying contours of the skin surface. The flexible neck may be formed to include a scoop for directing a stream of water through the blade-carrying razor head in a fanned array, providing an enhanced flushing action to remove debris and residue which accumulates on the blades.

13 Claims, 2 Drawing Sheets

FLEXIBLE RAZOR AND DISPENSER WITH PIVOTING HEAD

This application is a divisional patent application of patent application Ser. No. 10/389,855 filed on Mar. 14, 2003 now abandoned.

BACKGROUND OF THE INVENTION

1. Field of the Invention

This invention relates to a razor with a dispenser handle for dispensing a shaving material, such as shaving cream or gel, and, more particularly, the invention relates to a razor and dispenser having a flexible neck and pivoting head.

2. Discussion of the Related Art

Over the years, razors have been developed, marketed and improved to address the needs of the consumer. In particular, various improvements have been made to razors in order to produce a closer, more uniform shave with less nicking by allowing the blade-cutting surface to conform to the various configurations of anatomical skin surfaces. To address this need, many razor designs have been proposed which include a pivoting blade-carrying head which permits the cutting edge of the blade to more closely follow the skin surface contour without nicking the skin. Examples of razors with pivoting heads can be found in U.S. patents to Ferraro, U.S. Pat. No. 4,709,477; Edson, U.S. Pat. No. 3,593,416; and Trotta, U.S. Pat. No. 4,324,041. More recent examples of pivoting blade heads can be found in U.S. Pat. Nos. 5,784,790 and 5,787,586, both owned by the Gillette Company. Others have proposed a flexible structure which enables the blade-carrying head and a portion of the neck to flex relative to the handle of the razor. Examples of flexible razor designs can be found in the U.S. Patents to Armbruster et al., U.S. Pat. No. 5,560,106; Folson, U.S. Pat. No. 5,600,887; Althaus et al., U.S. Pat. No. 5,678,316; Iderosa, U.S. Pat. No. 5,038,472; and Pina, U.S. Pat. No. 6,223,442 B1.

Other developments in the razor art have proposed the combination of a razor with a shaving product dispensing container, wherein the container forms a part of the handle. Of particular relevance to the present invention is the U.S. Patent to Derin et al., U.S. Pat. No. 5,070,611, the contents of which are hereby incorporated by reference. Derin et al, provide a razor and dispenser wherein an aerosol container serves as part of the handle of the razor. The container includes a combination cap/actuator which dispenses shaving material when depressed. The cap/actuator may be depressed only when placed in a selected rotational position. When the cap/actuator is not in the selected operational position, a shoulder on the container and a skirt on the cap/actuator engage to prevent depression of the cap/actuator and, accordingly, dispensing of the shaving material. The Derin et al. razor and dispenser includes a handle with an integral rigid neck portion extending to a blade-carrying head. The head is fixed on the end of the neck and is not able to pivot.

The present invention provides an improved razor and dispenser and includes a flexible neck with a pivoting blade-carrying head. The head may carry a single blade or, alternatively, multiple blades in parallel spaced relation to one another in a similar manner as other known multiple blade razor heads, such as that found on the razor marketed under the trademark "MACH 3" from the Gillette company. In a preferred embodiment, the flexible neck is formed to include a scoop which is structured and disposed to direct a stream of water, running from a faucet, in a fanned array and through the head to thoroughly flush debris and residue from the blade surfaces.

OBJECTS AND ADVANTAGES OF THE INVENTION

With the foregoing in mind, it is a primary object of the present invention to provide a razor including a flexible and twistable neck and a pivoting blade-carrying razor head which, in combination, allow the cutting edges of the blades on the head to closely follow and conform to irregular surface configurations of the skin, thereby providing a close and uniform shave without nicking or cutting the skin.

It is a further object of the present invention to provide a razor which includes a flexible and twistable neck and pivoting blade-carrying head, and means formed on the neck to direct a stream of water through the blade-carrying razor head in a manner which enhances flushing action in order to thoroughly rinse debris and residue which accumulates on the blades.

It is still a further object of the present invention to provide a combined razor and dispenser which dispenses a shaving product (e.g. shaving cream or shaving gel) from the handle of the razor, and wherein the razor further includes a flexible and twistable neck and pivoting blade-carrying head to produce a closer and more uniform shave without nicking or cutting the skin.

It is still a further object of the present invention to provide a razor which may be manufactured as a disposable item, and wherein the razor includes a flexible neck and pivoting blade-carrying head.

It is yet a further object of the present invention to provide a combined razor and dispenser which dispenses a shaving material (e.g. shaving cream or shaving gel) from a handle of the razor, and wherein the razor/dispenser is manufactured as a disposable item, and further wherein the razor/dispenser includes a flexible and twistable neck and a pivoting blade-carrying head.

These and other objects and advantages of the present invention are more readily apparent with reference to the following detailed description taken in conjunction with the accompanying drawings.

SUMMARY OF THE INVENTION

The present invention is directed to a razor having a handle, a flexible neck extending from the top of the handle and a blade-carrying razor head pivotally fitted on the distal end portion of the neck. A lower portion of the handle functions as an actuator for dispensing shaving material contained within the handle and is operable between a stop position and a dispensing position. The neck is structured to flex and/or twist in a yielding action in response to external forces as the blade-carrying razor head travels over irregular or varying contours of the skin surface. The flexible neck may be formed to include a scoop for directing a stream of water through the blade-carrying razor head in a fanned array, providing an enhanced flushing action to remove debris and residue which accumulates on the blades.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
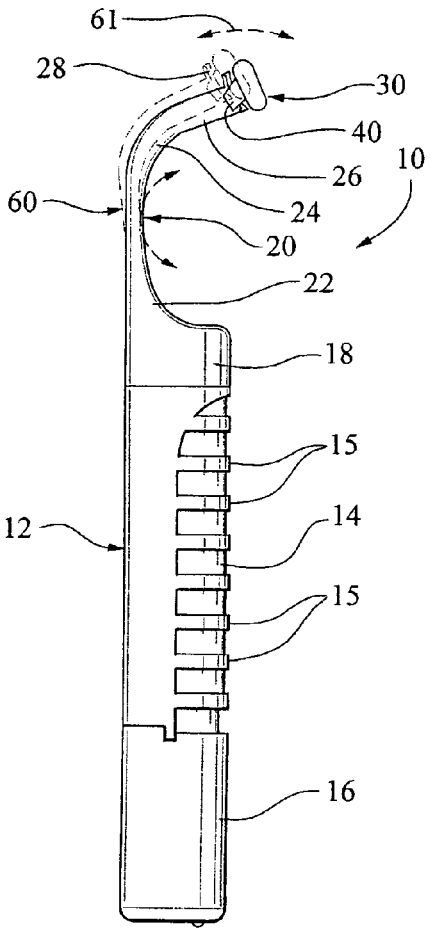
FIG. 1 is a side elevational view of the razor and dispenser of the present invention, in accordance with one preferred embodiment thereof, and wherein flexing and twisting movement of the neck is illustrated by the phantom lines and directional arrows.
Figure 2:
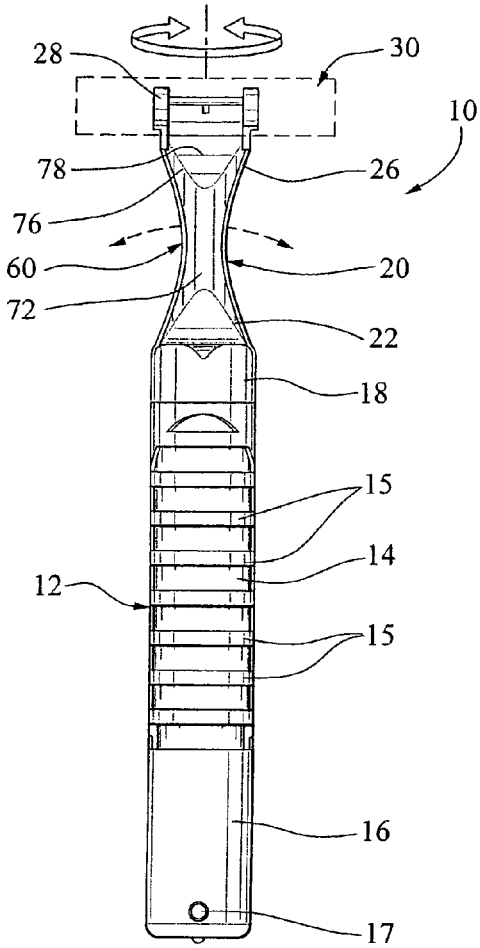
FIG. 2 is a front elevational view of the razor and dispenser of FIG. 1.
Figure 3:
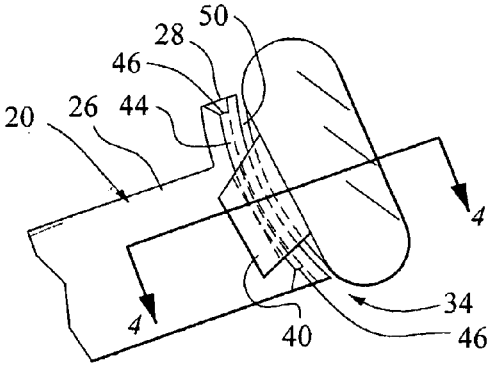
FIG. 3 is an isolated side elevational view of the distal end of the flexible and twistable neck and pivoting blade-carrying head of the present invention, in accordance with various preferred embodiments thereof.
Figure 4:
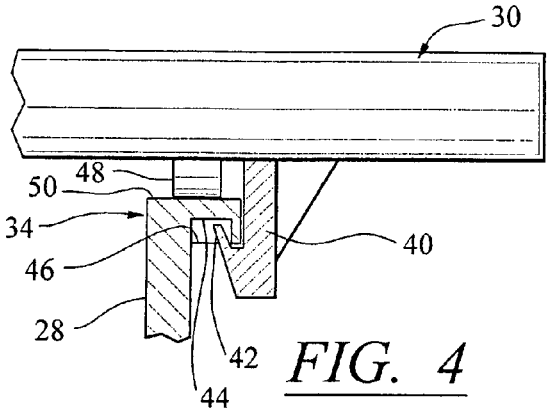
FIG. 4 is a plan view, in partial cross-section, taken along the plane as indicated by the arrows 4—4 in FIG. 3.

Referring to the several views of the drawings, and initially FIGS. 1 and 2, the razor of the present invention is shown and is generally indicated as 10. In each of the embodiments shown throughout the drawings, the razor 10 includes a handle 12 having a central portion 14 defining a grip zone, a lower portion 16 and an upper portion 18. The central portion 14 of the handle 12 is provided with a plurality of parallel, spaced ribs to discourage slipping and to enhance the grasp of the handle within the user's hand.

In at least one embodiment of the invention, the handle 12 includes a shaving material, such as shaving cream or shaving gel, contained therein. The hollow interior of the handle 12 may serve as the container for the shaving material which is contained under pressure. Alternatively, a pressurized supply of the shaving material may be contained within a cartridge or canister which is fitted within the hollow interior of the handle 12. The dispensing operation, to release a desired amount of the pressurized shaving material contents from within the handle is achieved in the same general manner as shown and described in detail in U.S. Pat. No. 5,070,611 to Derin et al. Specifically, the lower portion 16 of the handle 12 functions as an actuator for dispensing the shaving material through orifice 17 and into the hand of the user for application to the skin surface to be shaved. The lower portion 16, defining the actuator, is preferably operable by depressing the lower portion axially inward towards the central portion 14 of the handle to operate a valve mechanism communicating with the orifice 17. In a preferred embodiment, the lower portion 16 is operable between a stop position and a dispensing position by rotating the lower portion 16 in the manner described in U.S. Pat. No. 5,070,611. However, alternative means of operation of the actuator, including movement of the lower portion between the stop position and the dispensing position, are contemplated within the spirit and scope of the present invention.

The razor 10 is further provided with a neck 20 which extends upwardly from the upper portion 18 of the handle 12. The neck 20 includes a proximal portion 22 adjacent to the upper portion 18 of the handle 12 and a distal portion 26 terminating at a distal end 28. In a preferred embodiment, a bend 24 is formed between the proximal portion 22 and distal portion 26. In at least one embodiment, as shown in FIGS. 1 and 2, the neck 20 is integrally formed with the upper portion 18 of the handle.

A blade-carrying head 30 having one or more blades carried thereon is pivotally attached to the distal end 28 of the neck 20. As seen in FIGS. 1–2 and 6–8, the bend 24 in the neck 20 positions the blade-carrying head 30 at an optimal orientation relative to the handle 12 for engagement with the skin surface when shaving.

Figure 5:
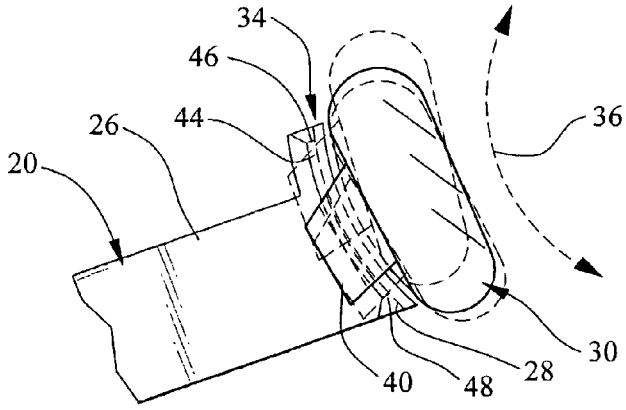
FIG. 5 is an isolated elevational view of the distal end of the flexible and twistable neck and pivoting blade-carrying head, wherein pivoting movement of the blade-carrying head is illustrated by the phantom lines and directional arrows.

In each of the embodiments of the invention, as shown throughout the several views of the drawings, the blade-carrying head 30 is pivotally fitted to the distal end 28 of the neck 20. Specifically, pivotal attachment means 34 are provided for securing the blade-carrying head 30 to the distal end 28 in a manner which permits pivoting movement of the head through an arcuate path as indicated by the directions arrows 36 in FIG. 5. In a preferred embodiment, the pivotal attachment means 34 is defined by cooperating structure on both the head 30 and the distal end 28 of the neck. Specifically, a pair of parallel arm members 40 extend from the back of the blade-carrying head 30 and include barbs 42 formed on an outboard side. The barbs 42 on each of the parallel arm members 40 are structured and disposed to be received within arcuate grooves 44 on the distal end 28 of the neck 20. The arcuate grooves 44 function as a track for guiding the barbs 42 therealong to achieve the pivoting arcuate movement of the head 30. Shoulders 46 at opposite ends of the arcuate grooves 44 limit travel of the arm members 40 relative to the distal end 28 of the neck, preventing separation of the head 40 from the distal end 28. A pair of knuckles 48 on the back of the blade-carrying head 30 engage a concave surface on the distal end of the neck, on an opposite side of the arcuate grooves 44. The knuckles 48 serve to capture the head on the distal end by sandwiching the distal end 28 between the barbs 42 and respective knuckles 48 so that the head 30 does not separate from the distal end 28. The knuckles 48 engage respective concave surfaces 50 on the distal end 28, maintaining contact therewith for sliding movement along the concave surfaces as the head 30 travels through the arcuate path of pivoting movement.

As described above, the neck 20 is structured and disposed to flex and twist relative to the handle 12. Specifically, flex means 60 are provided in accordance with several embodiments of the invention for permitting flexing and/or twisting movement of the neck 20, and particularly the distal portion 26 and blade-carrying head 30 relative to the handle 12 in response to a force applied to the head 30 as the head is pressed against the skin surface when shaving. The functional operation of the flex means 60 and pivotal attachment means 34 combine to achieve a close and uniform shave by allowing the blades on the head to maintain uniform and even pressure contact with the skin while yielding to irregularities in skin surface configurations as the head travels over the skin surface being shaved. In this manner, the cutting edges of the blades do not nick, cut or gouge irregular surfaces, such as bumps, clefts, moles and other imperfections or uneven areas of the skin surface.

Throughout the drawings, various embodiments of the flex means 60 are shown. Specifically, in FIGS. 1 and 2, the flex means 60 is defined by an area of reduced material in the neck 20, and particularly at the middle section of the neck. This reduced area of material enables the neck to both flex and twist when a sufficient force is applied to the head 30, as indicated by the directional arrows 61 in FIG. 1.

Figure 6:
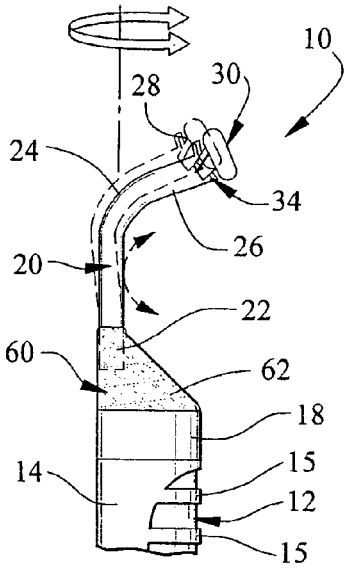
FIG. 6 is an isolated side elevational view of an upper portion of the razor and dispenser illustrating an alternative embodiment of the flexible and twistable neck.
Figure 7:
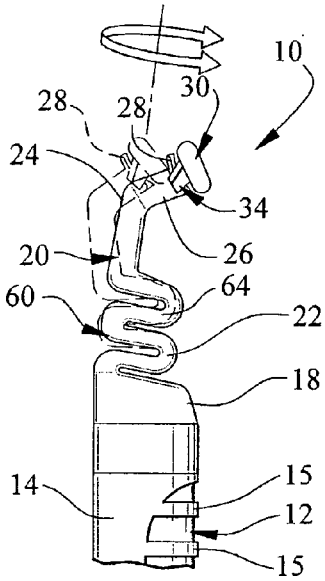
FIG. 7 is an isolated side elevational view of a top portion of the razor and dispenser illustrating yet another embodiment of the flexible and twistable neck.
Figure 8:
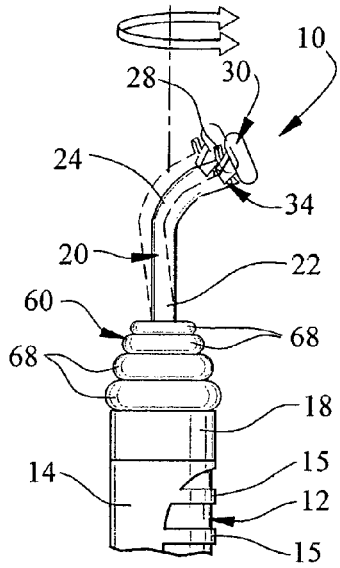
FIG. 8 is an isolated side elevational view of a top portion of the razor illustrating yet another embodiment of the flexible and twistable neck.

Other embodiments of the flex means 60 are shown in FIGS. 6–8. Specifically, the embodiment of FIG. 6 provides a section of elastomeric material 62, such as a rubber material, between the proximal portion 22 of the neck and the upper portion 18 of the handle. This enables the neck and head 30 to flex (as indicated by the phantom lines) and also twist (as indicated by the directional arrows) relative to the handle 12.

In FIG. 7, another embodiment of the flex means 60 is shown, wherein the proximal portion 22 of the neck 20 is formed in a serpentine configuration 64 to provide a spring structure. In this particular embodiment, the serpentine section 64 may be formed of the same material (e.g. plastic) as the upper portion 18 of the handle and the distal portion 26 of the neck 20. Alternatively, the serpentine section 64 may be formed of an elastomeric material to enhance the flexing and twisting action, as indicated by the phantom lines in FIG. 7.

Finally, FIG. 8 shows yet another embodiment of the flex means 60 wherein a plurality of elastomeric rings 68 are provided between the proximal portion 22 of the neck 20 and the upper portion 18 of the handle 12, allowing the neck 20 to flex (as indicated by the phantom lines) and/or twist when sufficient force is applied to the head 30. As seen in FIG. 8, the elastomeric rings 68 may be of varying size, with a lower most ring having the largest diameter and each of the successive rings progressively reducing in diameter and overall dimension.

In at least one embodiment of the invention, the neck 20 is formed and configured to provide a scoop structure 70 formed in the front face of the neck for directing a stream of water through the blade-carrying razor head 30 in a fanned array. This results in an enhanced flushing action which removes accumulated debris and residue from the blades. As seen in FIG. 2, the scoop structure 70 includes a concave surface 72 which narrows at area 74 to provide a funneling action. The scoop then widens at zone 76 to direct the flow of water into a fanned array and over flat surface 78 for passage through the blades on the head, thereby flushing and removing the accumulated debris and residue therefrom. It is noted that the scoop structure 70 also provides a convenient means for hanging the razor 10 on a hook or other projecting structure above a vanity or in a shower.

While the instant invention has been shown and described in accordance with preferred and practical embodiments thereof, it is recognized that departures from the instant disclosure are contemplated within the spirit and scope of the present invention which, therefore, should not be limited except as defined in the following claims as interpreted under the doctrine of equivalents.

What is claimed is:

1. A razor comprising:

a handle having a central portion, a lower portion, an upper portion and a longitudinal axis;

a flexible neck extending from said upper portion of said handle and at least partially along the longitudinal axis of said handle, and said flexible neck including a proximal portion and a distal portion terminating at a distal end;

a head fitted to said distal end of said neck and having at least one blade carried thereon; and said flexible neck being structured and disposed to flex generally perpendicular to the longitudinal axis and to twist about the longitudinal axis upon application of external forces to said head so that said head and said distal portion of said flexible neck move relative to said handle.

2. The razor as recited in claim 1 wherein said proximal portion of said flexible neck is formed in a serpentine configuration to promote both flexing and twisting movement of said head and said distal portion of said neck relative to said handle.

3. The razor as recited in claim 2 wherein said flexible neck is formed of an elastomeric material for promoting both said flexible and said twisting movement of said head and said distal portion of said neck relative to said handle.

4. The razor as recited in claim 1 wherein said neck includes a section formed of an elastomeric material for promoting both flexing and twisting movement of said flexible neck and said head relative to said handle.

5. A razor comprising:

a handle having a central portion, a lower portion, an upper portion and a longitudinal axis;

a flexible neck extending from said upper portion of said handle and at least partially along the longitudinal axis of said handle, and said neck including a proximal portion and a distal portion terminating at a distal end;

a head fitted to said distal end of said neck and having at least one blade carried thereon, and said head being pivotally movable relative to said distal end through a range of arcuate movement; and said flexible neck being structured and disposed to flex generally perpendicular to the longitudinal axis and to twist about the longitudinal axis upon application of external forces to said head so that said head and said distal portion of said flexible neck move relative to said handle.

6. The razor as recited in claim 5 wherein said flexible neck includes a bend between said proximal portion and said distal portion.

7. The razor as recited in claim 5 wherein said flexible neck includes an area of reduced material to promote both said flexing and said twisting movement of said neck and said head relative to said handle.

8. A razor comprising:

a handle having a central portion, a lower portion an upper portion and a longitudinal axis;

an actuator on said handle, said actuator being operable to dispense a shaving material contained within said handle;

a flexible neck extending from said upper portion of said handle at least partially along the longitudinal axis of said handle, and said flexible neck including a proximal portion and a distal portion terminating at a distal end;

a head fitted to said distal end of said neck and having at least one blade carried thereon, and said head being pivotally movable relative to said distal end through a range of arcuate movement; and said flexible neck being structured and disposed to flex generally perpendicular to the longitudinal axis and to twist about the longitudinal axis upon application of external forces to said head so that said head and said distal portion of said flexible neck move relative to said handle.

9. The razor as recited in claim 8 wherein said flexible neck includes a bend between said proximal portion and said distal portion.

10. The razor as recited in claim 8 wherein said flexible neck includes an area of reduced material to promote both said flexing and said twisting movement of said neck and said head relative to said handle.

11. The razor as recited in claim 1 wherein said flexible neck includes a bend between said proximal portion and said distal portion.

12. The razor as recited in claim 1 wherein said flexible neck includes an area of reduced material to promote both flexing and twisting movement of said neck and said head relative to said handle.

13. The razor as recited in claim 1 further including:

an actuator on said handle, said actuator being operable to dispense a shaving material contained within said handle.

* * * * *